US007296640B2

(12) United States Patent
Tettleton

(10) Patent No.: US 7,296,640 B2
(45) Date of Patent: Nov. 20, 2007

(54) SOLIDS CONTROL SYSTEM

(75) Inventor: Tab Tettleton, Spring, TX (US)

(73) Assignee: National-Oilwell, L.P., Houston, TX (US)

( * ) Notice: Subject to any disclaimer, the term of this patent is extended or adjusted under 35 U.S.C. 154(b) by 480 days.

(21) Appl. No.: 10/853,797

(22) Filed: May 26, 2004

(65) Prior Publication Data

US 2005/0006149 A1 Jan. 13, 2005

Related U.S. Application Data

(60) Provisional application No. 60/476,272, filed on Jun. 5, 2003.

(51) Int. Cl.
*E21B 21/06* (2006.01)

(52) U.S. Cl. ..... 175/66; 175/206; 175/207; 210/261

(58) Field of Classification Search ..... 175/206, 175/207, 66; 210/241, 261, 263, 265, 294, 210/322, 513
See application file for complete search history.

(56) References Cited

U.S. PATENT DOCUMENTS 3,160,106 A * 12/1964 Ashworth ..... 415/112
4,474,254 A * 10/1984 Etter et al. ..... 175/206
4,899,832 A * 2/1990 Bierscheid, Jr. ..... 173/187
5,853,583 A * 12/1998 Shah ..... 210/340
6,070,764 A 6/2000 Cline et al.
6,506,310 B2 * 1/2003 Kulbeth ..... 210/780
6,863,809 B2 * 3/2005 Smith et al. ..... 210/202

FOREIGN PATENT DOCUMENTS

| | | |
|---|---|---|
| DE | 195 07 172 | 8/1996 |
| EP | 0 748 924 A | 12/1996 |
| GB | 2 350 851 | 12/2000 |

OTHER PUBLICATIONS

European Search Report of Appln. No. 04253224.2 dated Oct. 5, 2004; (3 p.).

* cited by examiner

*Primary Examiner*—Kenneth Thompson
(74) *Attorney, Agent, or Firm*—Conley Rose, P.C.

(57) ABSTRACT

A mobile solids control system for the processing of drilling fluids. The solids control system includes a suction tank skid, a suction platform skid, a shaker tank skid, and an equipment platform skid. The suction tank skid and shaker tank skid include the drilling fluid storage tanks, pumps to effectuate the flow of fluid through the system, and agitators to circulate fluid within the tanks. The pumps are preferably centrifugal pumps mounted vertically within notches or recesses built into the sides of the tank skids. The suction platform skid and the equipment platform skid are installed on top of the tank skids, and include solids control equipment used to process the drilling fluid.

23 Claims, 4 Drawing Sheets

SOLIDS CONTROL SYSTEM

CROSS-REFERENCE TO RELATED APPLICATIONS

The present application claims priority to U.S. Provisional Application No. 60/476,272, filed Jun. 5, 2003, titled "Solids Control System," and hereby incorporated herein by reference for all purposes.

STATEMENT REGARDING FEDERALLY SPONSORED RESEARCH OR DEVELOPMENT

Not applicable.

BACKGROUND OF THE INVENTION

The embodiments of the present invention relate generally to systems for removing and controlling solids suspended in a liquid slurry. More particularly, the embodiments provide a mobile system for storing and processing drilling fluids.

Rigs used for drilling hydrocarbon wells are large, complex assemblies of machinery. While drilling rigs used offshore are often integrated into a single platform, almost all rigs used to drill wells on land are designed to be disassembled, transported between drilling sites, and reassembled. Although some rigs may be designed to be moved by helicopter or airplane, the majority of rigs are moved by trucks and trailers. Thus, many land rigs are designed to disassemble into components sized so as to be quickly and easily loaded onto, transported by, and offloaded from a trailer.

The process of assembling a land rig for drilling operations is known as "rig up." During rig up, all of the various components of the drilling rig are assembled and tested prior to any drilling activity taking place. The rig up procedure may last anywhere from a couple of days to more than a week, depending on the type of rig being assembled and any problems encountered during the process. Because drilling the well can not commence until rig up is complete, it is desirable to minimize the time spent assembling the drilling rig.

The entire rig up process must be performed in reverse order to "rig down," the process used to disassemble the rig for transportation to another location. During rig down, the individual rig components are disconnected and loaded, by cranes or winches, onto trailers for transport. The rig down procedures further add to the downtime that the rig spends between drilling wells, and are therefore conducted as quickly as safety permits.

The amount of downtime spent between drilling wells is often limited by the contract under which the rig is operating. These contracts often specify the time permitted for rig up and rig down, and that any time beyond the permitted limits will not be paid for by the rig lessee, but will be paid for by the rig operator. Thus, any equipment or procedures that may be available to lessen the amount of time needed for rig up and rig down activities are desirable and would be welcomed by the industry.

One key component of a drilling rig is the drilling fluid circulation system or mud system, which circulates drilling fluid (mud) through the wellbore. The circulation system is also used to maintain the density of the drilling fluid by removing drilled cuttings from the fluid, and adding other solids to the fluid as may be desired. The density of the drilling fluid is critical to hole cleaning, rate of penetration, and pressure control in the well. Hole cleaning and rate of penetration are important factors in the efficiency of the drilling process, while pressure control is critical to safely drilling a well.

In general operation, drilling fluid is pumped by high-pressure mud pumps through the drill string and into the wellbore. The fluid exits the drill string at the bit and returns to the surface through the annulus between the drill string and the wellbore, carrying cuttings from the hole to the surface. The hydrostatic pressure from the column of drilling fluid prevents fluids from the surrounding formation from entering the wellbore and potentially causing a loss of well control.

At the surface, the drilling fluid is then processed, in order to maintain the desired density, before it is pumped back through the drill string into the hole. Solids control equipment such as shakers, degassers, desilters, desanders, and centrifuges may be used to process the drilling fluid at the surface by removing solids and entrained gases from the fluid. The density of the drilling fluid may be increased by adding a higher density fluid or select solid materials to the fluid. The drilling fluid, including a reserve volume is typically stored in tanks or pits at the surface before being recirculated through the well.

For land-based, mobile drilling rigs, the circulation system is often subdivided into skid-mounted modules that can be easily transported by truck between well sites. These skid-mounted modules are normally designed to be lifted by cranes onto trailers or pulled onto flatbed trailers by winches. Common modules include mud tanks, solids control equipment, jetting equipment, and a gravity fed manifold. A common circulation system may include more than one module of each type, but every module employed in the system increases the time needed for rig up and rig down operations.

The mud tank modules provide a reservoir of drilling fluid for use during circulation. Most conventional mud tank modules include open top, rectangular tanks, but round tanks are also occasionally used. At one end of the typical mud tank module is a "porch" for mounting pumps and other equipment that is used to move fluid into and out of the tanks. The mud tanks also preferably have access hatches or manways through the sides of the tanks designed to provide access into the tank to facilitate cleaning, since solids tend to accumulate in the tanks. The tanks are usually cleaned periodically during operations, and also between well drilling operations. The mud tanks may also have agitators or stirrers provided to keep the fluid circulating within a single tank in order to minimize settling of the solids.

An assortment of other modules are also used in conjunction with the mud tanks and are thus in fluid communication with the tanks. The solids control module includes the shakers, desilters, desanders, mudcleaners, agitators, mud hoppers, centrifuges, degassers, etc. and may include one or more skids, to which the equipment is mounted. Jetting equipment is used to supply high pressure fluid to clean or remove deposits from the inside of the mud tanks. Jetting equipment may also be used in conjunction with a tanker truck or vacuum truck to clean out the mud tanks and remove unwanted fluids. The gravity fed manifold is used to control and route the supply of drilling fluid from the mud tanks to the triplex pumps, which are used to circulate the drilling mud down the wellbore and throughout the system. The jetting equipment, and manifold all require one or more skids each.

With all of the different equipment that has to be integrated into a typical fluid circulation system, it can be seen that the effort required to transport and assembly such a system is considerable. Thus, there remains a need in the art for systems that decrease the time needed for rig up and rig down of a fluid circulation system. Therefore, the embodiments of the present invention are directed to methods and apparatus for providing a mobile fluid circulation system that seeks to overcome certain of the limitations of the prior art.

SUMMARY OF THE PREFERRED EMBODIMENTS

The preferred embodiments provide a mobile solids control system for the processing of drilling fluids. The solids control system includes a suction tank skid, a suction platform skid, a shaker tank skid, and an equipment platform skid. The suction tank skid and shaker tank skid include the drilling fluid storage tanks, pumps to effectuate the flow of fluid through the system, and agitators to circulate fluid within the tanks. The pumps are preferably centrifugal pumps mounted vertically within notches or recesses built into the sides of the tank skids. The suction platform skid and the equipment platform skid are installed on top of the tank skids, and include solids control equipment used to process the drilling fluid.

The vertically mounted, centrifugal pumps are preferably connected in fluid communication with at least two fluid tanks and are suited for use in transferring fluid between tanks, moving fluid through the solids control equipment, supplying fluid for jetting and cleaning the tanks, and providing a fluid supply for priming the triplex pumps. The use of the centrifugal pumps for priming the triplex pumps eliminates the need for a gravity manifold for priming and simplifies the operation of the system. The jetting and cleaning fluid supplied by the centrifugal pumps may be dispersed into the tanks through cleaning nozzles, which may by integrated into the rotating shafts of the agitators or disposed within the tanks separately. The centrifugal pumps may also be used to empty the tanks when required without requiring the use of a vacuum truck.

The multiple operations performed by the centrifugal pumps provide for a substantially self-sufficient solids control system that can be used interchangeably with similar systems of different fluid capacities with the same drilling rig. Likewise, the preferred system provides a solids control system that is easily integrated into new or existing drilling rigs.

In the preferred embodiments, the solids control system reduces the number of trucks and crane lifts required to move the system between locations. Each platform skid is lifted by a crane and loaded onto a truck for transport. The tank skids can then also be loaded onto trucks and the entire system can be transported in four truckloads. Once in the new location, the tank skids are offloaded and the platform skids are lifted into place on top of the tank skids.

Thus, the present invention comprises a combination of features and advantages that enable it to provide for a modular, mobile solids control system. These and various other characteristics and advantages of the preferred embodiments will be readily apparent to those skilled in the art upon reading the following detailed description and by referring to the accompanying drawings.

BRIEF DESCRIPTION OF THE DRAWINGS

For a more detailed understanding of the preferred embodiments, reference is made to the accompanying Figures, wherein.

DETAILED DESCRIPTION OF THE PREFERRED EMBODIMENTS

Figure 1:
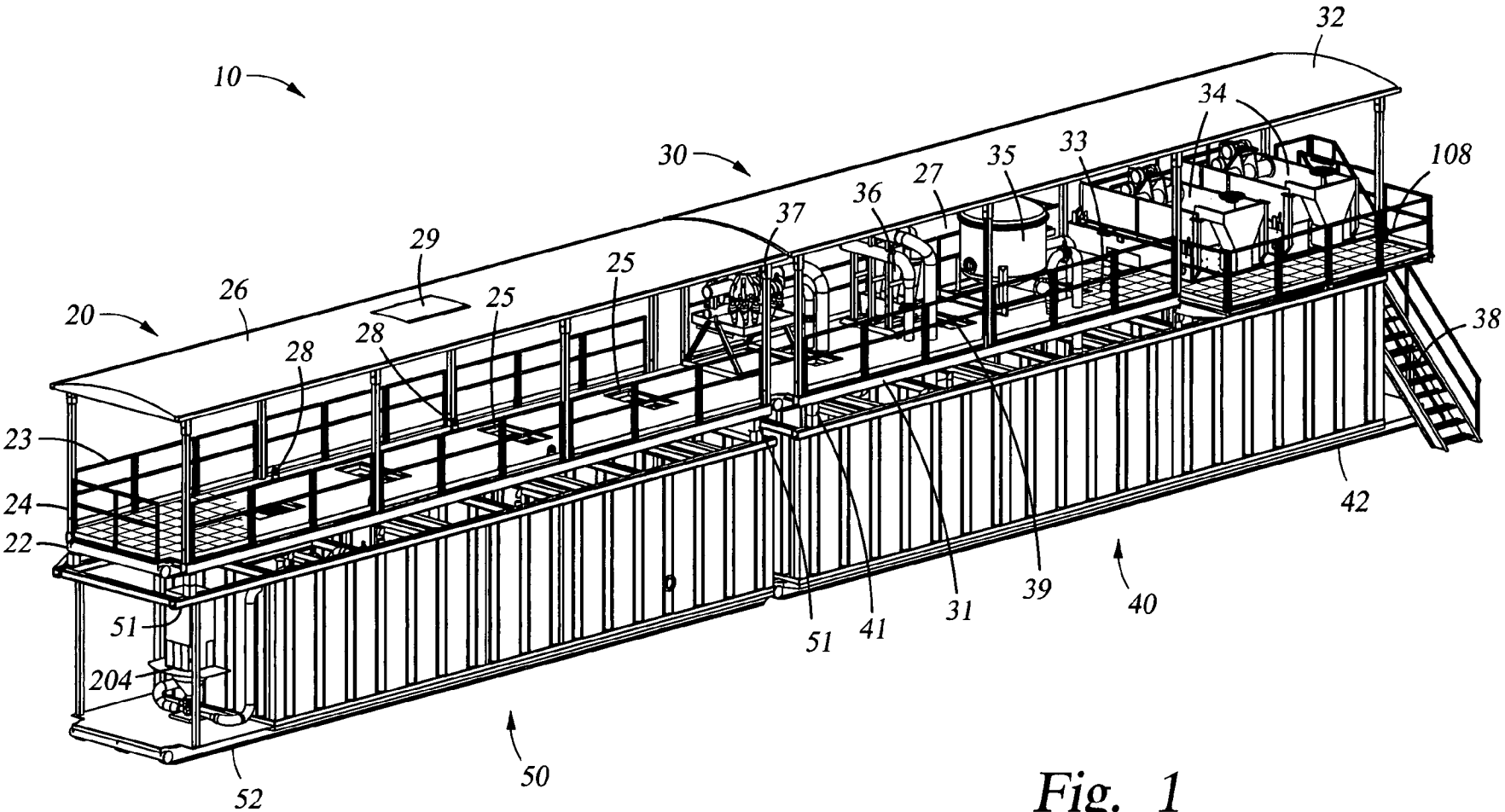
FIG. 1 is a front isometric view of one embodiment of a solids control system.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

FIG. 1 shows one embodiment of a solids control system 10 including a suction platform skid 20, equipment platform skid 30, shaker tank skid 40, and suction tank skid 50. Suction platform skid 20 and equipment platform skid 30 stack, respectively, on top of suction tank skid 50 and shaker tank skid 40. In the preferred embodiments, the assembled skids comprise a self-contained, mobile, solids control system that provides a more compact, and more easily transportable system than conventional systems.

Suction platform skid 20 provides a working platform 24 above suction tank skid 50. Roof 26 covers platform 24, providing shelter from the environment and a cover for the open top mud tanks in suction tank skid 50. Working platform 24 is preferably a metal or fiberglass grating providing a non-slip working surface. In an alternate embodiment, working platform 24 may be formed from treaded plates, which would provide the tank covering function of roof 26. In this alternate embodiment, roof 26 may be eliminated. Working platform 24 is also preferably surrounded by handrails 23 to provide a secure, elevated working surface.

Suction platform skid 20 is built on a structural frame 22 that is adapted to attach to the top of suction tank skid 50 by way of posts 51 that allow for attachment between platform skid 20 and tank skid 50 and provide a gap between the two structures. Lifting points 28 are positioned on frame 22 and can be accessed by hatch 29 through roof 26. Access openings 25 through platform 24 provide access to suction tank skid 50. The overall dimensions of suction platform skid 20 are preferably within the maximum size limits for interstate road transportation.

Equipment platform skid 30 provides a working platform 33 and mounting locations for solid control equipment such as shakers 34, degasser 35, desander 36, and desilter 37. Roof 32 covers platform 33, providing shelter from the environment and a cover for the solids control equipment and the open top mud tanks in shaker tank skid 40. Working platform 33 is preferably a metal or fiberglass grating providing a non-slip working surface. In an alternate embodiment working platform 33 may be formed from treaded plates, which would provide the tank covering function of roof 32. In this alternate embodiment, roof 32 may be eliminated. Working platform 33 is also preferably surrounded by handrails 27 to provide a secure, elevated working surface Equipment platform skid 30 includes a structural base 31 that is adapted to attach to the top of shaker tank skid 40 by way of posts 41 that allow for attachment between platform skid 30 and tank skid 40 and provide a gap between the two structures. Lifting points (not shown) are positioned on base 31 and can be accessed by hatch (not shown) through roof 32. Access openings through platform 33 provide clearance for plumbing to the solids control equipment and access to tank skid 40.

The overall dimensions of suction platform skid 20 are preferably within the maximum size limits for interstate road transportation. Stairs 38 are also provided to enable access to skid 30 from ground level as skid 30 is designed to be installed on top of shaker tank skid 40. Stairs 38 are preferably removable for transport as are platforms 108 that extend beyond the footprint of base 31.

Figure 4:
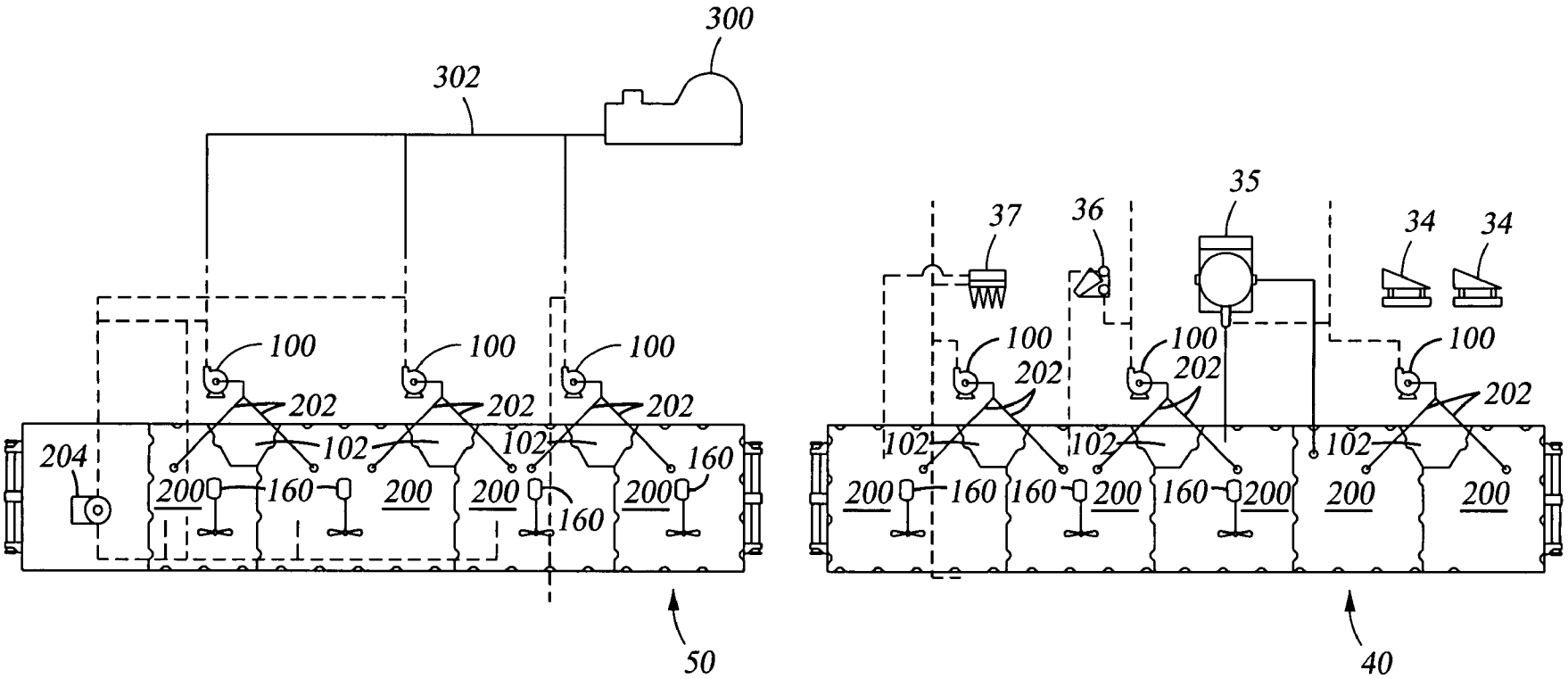
FIG. 4 is top plan view of the suction tank skid and shaker tank skid of the system shown in FIGS. 1 and 2, and shows a partial, schematic flow diagram of the system.

Shaker tank skid 40 and suction tank skid 50 provide skid-type platforms 42, 52 to which a plurality of mud tanks are mounted. As can be seen in FIG. 4, the preferable mud tanks 200 are generally rectangular, flat-sided tanks. In the preferred embodiments, system 10 can handle 1500 barrels of fluid. As will be discussed, tanks 200 are interconnected by piping and valves 202 to control the flow of fluid between tanks, to the solids control equipment, and out to the triplex pumps. The tanks 200 are preferably fitted with agitators 160 that are used to promote circulation through the tank. The tank skids 40, 50 also preferably include pumps 100 used to move the fluid between the tanks 200 and into and out of the system.

Figure 2:
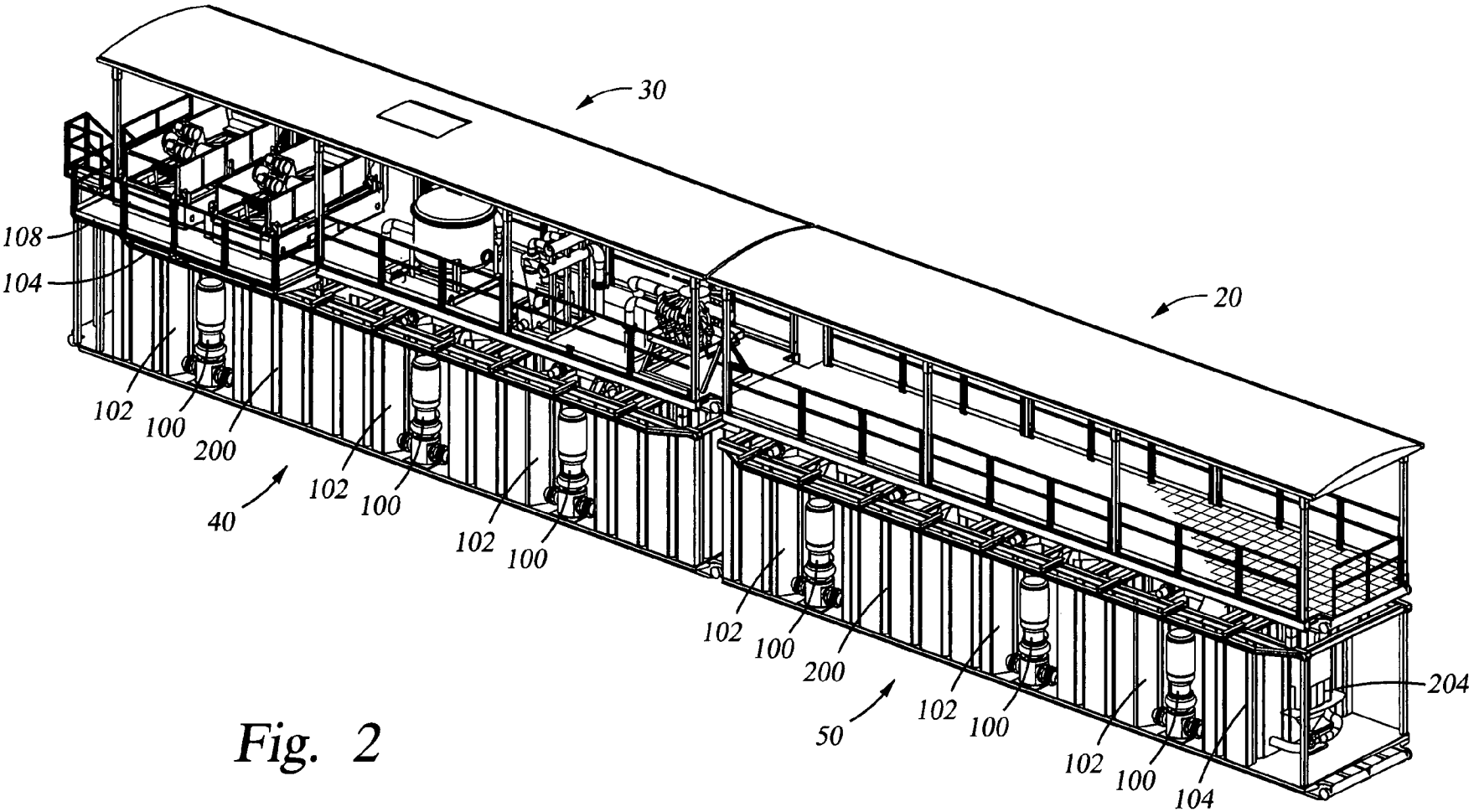
FIG. 2 is a rear isometric view of the system of FIG. 1.

Referring now to FIG. 2, a rear view of system 10 is shown. Pumps 100 are centrifugal pumps, oriented vertically and nested into recesses or notches 102 formed on the sides of shaker tank skid 40 and suction tank skid 50. Notches 102 allow pumps 100 to fit inside the generally rectangular footprint of the tank skids 40, 50 without adversely effecting circulation of fluid through the individual tanks. An overhead rail system 104, in conjunction with trolleys (not shown), allows for easy lifting and removal of pumps 100 for maintenance or replacement.

Figure 3C:
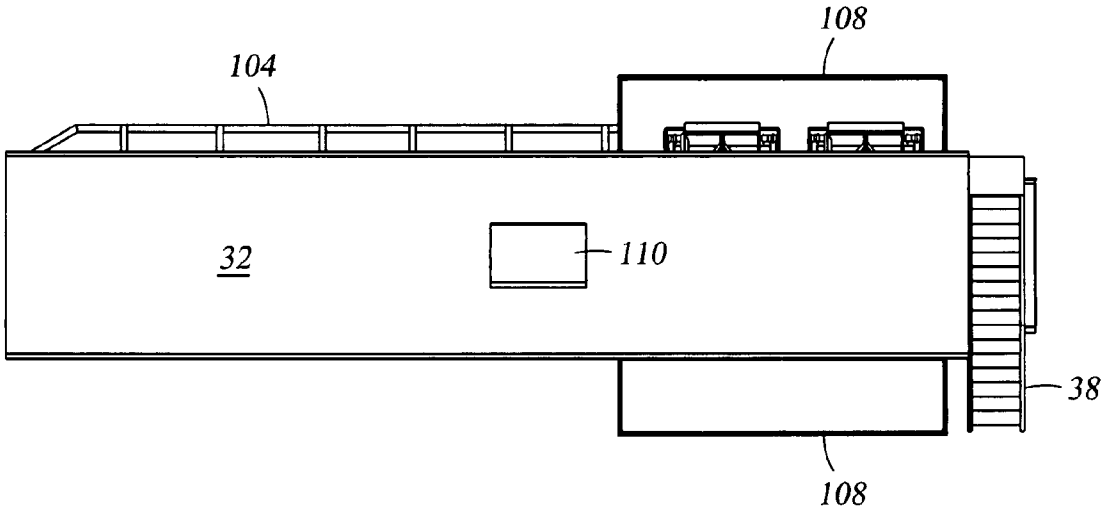
FIG. 3A–3C are views of the shaker tank skid and equipment platform skid of the system shown in FIG. 1.
Figure 3B:
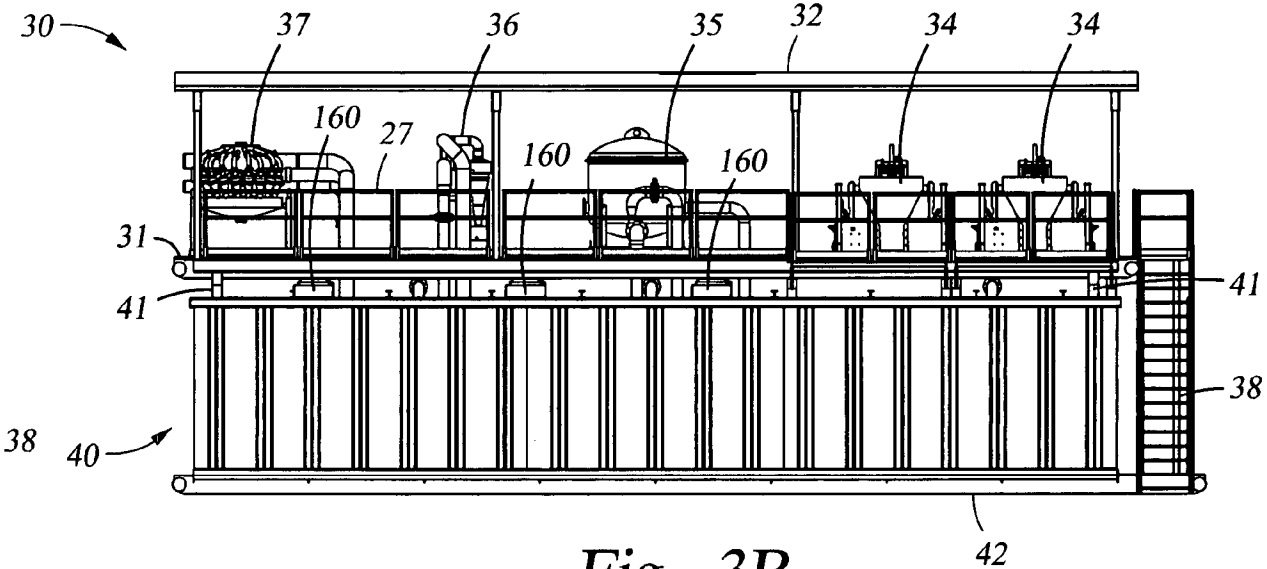
Figure 3A:
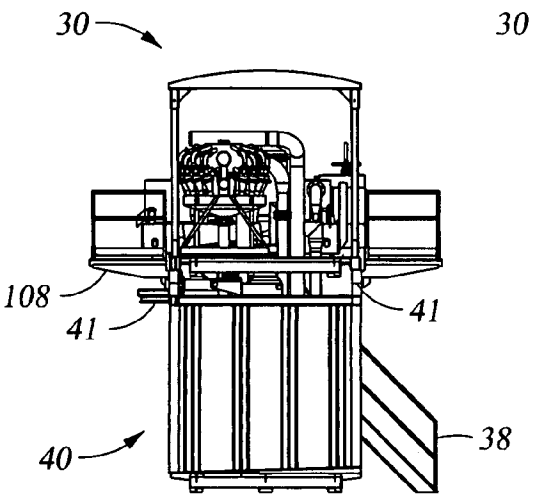

Shaker tank skid 40 and equipment platform skid 30 are shown in FIGS. 3A–3C. FIG. 3A shows an elevation view of equipment platform skid 30 mounted atop shaker tank skid 40. Agitators 106 are mounted to tank skid 40 below equipment platform skid 30 and provide agitation to the mud tanks. As can be seen in end view FIG. 3B and top view FIG. 3C, platforms 108 project beyond the footprint of skid 40. Platforms 108 are preferably removable or hinged to shaker tank skid 40 so that they can be collapsed during transport of the skid. Top view FIG. 3C also shows rail system 104 and access hatch 110 through roof 32, which allows access to lifting points on equipment platform skid 30.

FIG. 4 shows mud tanks 200 in plan view, with a partial hydraulic schematic of system 10 imposed thereon. Shaker tank skid 40 and includes five mud tanks 200, which are connected by three pumps 100 controlled by valves 202. Agitators 106 are provided for three mud tanks 200. Shakers 34, degasser 35, desander 36, and desilter 37 draw fluid from the mud tanks 200, process the fluid, and return it to the tanks 200. Suction tank skid 50 provides four additional mud tanks 200, pumps, 100, valves 202, and agitators 160. Suction tank skid 50 also includes a mud hopper 204 that is used to add solids to the drilling mud. Tanks 200 may also include cleaning nozzles (not shown) for jetting, or cleaning, the tanks. These cleaning nozzles may be suspended in the tank on a rotating shaft or may be integrated into agitators 160. Cleaning nozzles integrated into agitators 160 may be preferred in order to reduce the equipment that is suspended in a tank because each interference with circulation in a tank may have detrimental effects on the fluid stored in that tank.

Pumps 100 can be used to provide the fluid pressure needed for moving fluid through the solids control equipment, for jetting and cleaning the tanks, and transferring fluid between tanks 200. Each pump 100 is preferably in fluid communication with at two tanks 200 so that the number of pumps can be minimized. Pumps 100 allow cleaning and jetting to be performed while drilling operations are ongoing since, unlike conventional systems, the high-pressure triplex pumps are not required in system 10 for cleaning and jetting operations. Pumps 100 supply can supply fluids to the cleaning nozzles or can be used to draw fluid out of the tanks, thus eliminating the need, in conventional systems, for vacuum trucks to be used to empty the tanks.

Pumps 100 may also be used to supply pressurized fluid for priming the high-pressure, triplex pumps. In most conventional systems, a separate manifold is used to supply the fluid that is needed to prime the triplex pumps 300. System 10 can be connected to the triplex pumps 300 via an easily installed flexible hose 302, and pumps 100 can supply sufficient fluid to prime the triplex pumps 300. This eliminates the need for a special manifold and the corresponding equipment, transportation, and rig up/rig down costs associated therewith.

Another key advantage to solids control system 10 is the simplicity of rig up and rig down. From the fully assembled position shown in FIG. 1, suction platform skid 20 and equipment platform skid 30 are lifted, one at a time, by a crane and placed onto trailers for transport. The crane attaches to lift points on the base structure of the skid 20, 30, which can be accessed by opening hatch 28 in the roof. This configuration eliminates the need for any personnel to be on top of the roofs of the skid to attach to the crane, and allows the roof structure to be designed for smaller loads than would be necessary if the skid were lifted through the roof structure. Once the suction platform skid 20 and equipment platform skid 30 are removed, suction tank skid 50 and shaker tank skid 40 can be loaded onto trailers for transport. Each of the skids 20, 30, 40, and 50 requires a single truck load to transport. Thus, system 10 can be transported in four loads and only requires two crane lifts (or picks) for rig up or rig down.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the present inventive concept, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A solids control system comprising:

a shaker tank skid comprising a fist tank and an inlet for receiving a liquid containing solid particles;

an equipment platform skid comprising equipment for removing at least a portion of the solid particles from the liquid received by said shaker tank skid;

a suction tank skid comprising a second tank and an inlet for receiving liquid from said shaker tank skid, wherein said equipment skid is stacked on top of said shaker tank skid; and a suction platform skid, wherein said suction platform skid is stacked on top of said suction tank skid.

2. The solids control system of claim 1 wherein said suction platform skid provides a working platform above said suction tank skid and substantially covers the second tank, wherein the working platform comprises access opening providing access to said suction tank skid.

3. The solids control system of claim 2 wherein said suction platform skid further comprises lifting points accessible for overhead lifting.

4. The solids control system of claim 1 wherein the equipment comprises one or more of a shaker; a degasser; a desander, and a desilter.

5. The solids control system of claim 4 wherein said shaker tank skid further comprises a working platform above said shaker tank and substantially covers the first tank, wherein the working platform compnses access opening providing access to said shaker tank skid.

6. The solids control system of claim 5 wherein said equipment platform skid further comprises lifting points accessible for overhead lifting.

7. The solids control system of claim 1 wherein the first and second tanks comprise a plurality of interconnected flat-sided tanks.

8. The solids control system of claim 7 wherein the first and second tanks comprise agitators.

9. The solids control system of claim 1 wherein the first tank comprises a plurality of tank compartments and said shakei tank skid finther comprises a plurality of vertically-mounted centrifugal pumps interconnected to the tank compartments.

10. The solids control system of claim 1 wherein the second tank comprises a plurality of tank compartments and said suction tank skid further comprises a plurality of vertically-mounted centrifugal pumps interconnected to the tank compartments.

11. The solids control system of claim 1 wherein said shaker tank skid, said equipment platform skid, and said suction tank skid are sized so as to allow transportation by road.

12. A system for processing drilling fluid comprising:

a plurality of shaker tanks disposed on a shaker tank skid and operable to receive drilling mud from a drilling system;

solids control equipment disposed on an equipment platform skid, wherein the equipment platform skid is connected to the top of the shaker tank skid, wherein said solids control equipment is operable to draw drilling mud fiom said shaker tanks and process the drilling mud;

a plurality of suction tanks disposed on a suction tank skid, wherein said suction tanks are operable to receive drilling mud that has been processed by said solids control equipment; and a suction platform skid connected to the top of the suction tank skid and comprising a platform providing access to said suction tanks, wherein said suction tank skid substantially covers said suction tanks.

13. The system of claim 12 further comprising a plurality of vertically-mounted, centrifugal pumps disposed on the shaker tank skid, wherein the centrifugal pumps are in fluid communication with said plurality of shaker tanks.

14. The system of claim 13 wherein the centrifugal pumps are operable to transfer fluid between said shaker tanks, move fluid through said solids control equipment, and supply fluid for jetting and cleaning said shaker tanks.

15. The system of claim 12 further comprising a plurality of agitators disposed within said plurality of shaker tanks.

16. The system of claim 12 wherein said solids control equipment includes at least one or more of a shaker, a degasser, a desander, and a desilter.

17. The system of claim 12 further comprising a plurality of vertically-mounted, centrifugal pumps disposed on the suction tank skid, wherein the centrifugal pumps are in fluid communication with said plurality of suction tanks.

18. The system of claim 17 wherein the centrifugal pumps are operable to transfer fluid between said suction tanks, supply fluid for jetting and cleaning said suction tanks, and prime pumps used to supply fluid to the drilling system.

19. The system of claim 12 further comprising a plurality of agitators disposed within said plurality of suction tanks.

20. The system of claim 12 wherein said shaker tanks and said suction tanks are open-topped, flat-sided tanks.

21. The system of claim 12 wherein the shaker tank skid, the equipment platform skid, the suction tank skid, and the suction platform skid are sized so as to allow transportation by road.

22. A solids control system comprising:

a shaker tank skid comprising a first tank, a plurality of vertically-mounted centrifugal pumps, and an inlet for receiving a liquid containing solid particles, wherein the first tank comprises a plurality of tank compartments interconnected to the centrifugal pumps;

an equipment platform skid comprising equipment for removing at least a portion of the solid particles horn the liquid received by said shaker tank skid; and a suction tank skid comprising a second tank and an inlet for receiving liquid from said shaker tank skid, wherein said equipment skid is stacked on top of said shaker tank skid.

23. The solids control system of claim 22 wherein the second tank comprises a pluuality of tank compartments and said suction tank skid further comprises a plurality of vertically-mounted centrifugal pumps interconnected to the tank compartments.

* * * * *